US009343020B2

(12) United States Patent
Heide et al.

(10) Patent No.: US 9,343,020 B2
(45) Date of Patent: May 17, 2016

(54) METHODS AND APPARATUS FOR VISUAL DISPLAY

(71) Applicants: Felix Heide, Vancouver (CA); Gordon Wetzstein, Palo Alto, CA (US); James Gregson, Vancouver (CA); Ramesh Raskar, Cambridge, MA (US); Wolfgang Heidrich, Thuwal (SA)

(72) Inventors: Felix Heide, Vancouver (CA); Gordon Wetzstein, Palo Alto, CA (US); James Gregson, Vancouver (CA); Ramesh Raskar, Cambridge, MA (US); Wolfgang Heidrich, Thuwal (SA)

(73) Assignee: Massachusetts Institute of Technology, Cambridge, MA (US)

( * ) Notice: Subject to any disclaimer, the term of this patent is extended or adjusted under 35 U.S.C. 154(b) by 0 days.

(21) Appl. No.: 14/451,666

(22) Filed: Aug. 5, 2014

(65) Prior Publication Data

US 2015/0035880 A1 Feb. 5, 2015

Related U.S. Application Data

(60) Provisional application No. 61/862,295, filed on Aug. 5, 2013.

(51) Int. Cl.
*G09G 3/36* (2006.01)

(52) U.S. Cl.
CPC ..... *G09G 3/36* (2013.01); *G09G 2300/023* (2013.01); *G09G 2340/0457* (2013.01)

(58) Field of Classification Search
CPC ..... G06F 3/041; G06F 3/0418; G06F 3/044
See application file for complete search history.

(56) References Cited

U.S. PATENT DOCUMENTS

| | | | | |
|---|---|---|---|---|
| 5,777,588 | A * | 7/1998 | Woodgate | G02B 27/2214 345/6 |
| 6,456,339 | B1 | 9/2002 | Surati et al. | |
| 8,290,309 | B2 | 10/2012 | Hsieh et al. | |
| 8,594,464 | B2 | 11/2013 | Liu | |
| 8,675,999 | B1 | 3/2014 | Liang et al. | |
| 2008/0174614 | A1 * | 7/2008 | Whitehead | H04N 9/3138 345/694 |
| 2010/0290009 | A1 * | 11/2010 | Chen | G03B 21/00 353/31 |

OTHER PUBLICATIONS

Aliaga, D., et al., 2012, Fast high-resolution appearance editing using superimposed projections, ACM Transactions on Graphics (TOG), vol. 31 Issue 2, Article No. 13, ACM New York, NY, USA, Apr. 2012.

(Continued)

*Primary Examiner* — Shaheda Abdin
(74) *Attorney, Agent, or Firm* — Stephen R. Otis

(57) ABSTRACT

In exemplary implementations of this invention, light from a backlight is transmitted through two stacked LCDs and then through a diffuser. The front side of the diffuser displays a time-varying sequence of 2D images. Processors execute an optimization algorithm to compute optimal pixel states in the first and second LCDs, respectively, such that for each respective image in the sequence, the optimal pixel states minimize, subject to one or more constraints, a difference between a target image and the respective image. The processors output signals to control actual pixel states in the LCDs, based on the computed optimal pixel states. The 2D images displayed by the diffuser have a higher spatial resolution than the native spatial resolution of the LCDs. Alternatively, the diffuser may be switched off, and the device may display either (a) 2D images with a higher dynamic range than the LCDs, or (b) an automultiscopic display.

17 Claims, 9 Drawing Sheets

(56) References Cited

OTHER PUBLICATIONS

Berthouzoz, F., et al., Resolution enhancement by vibrating displays, ACM Transactions on Graphics (TOG), vol. 31 Issue 2, Article No. 15, ACM New York, NY, USA, Apr. 2012.
Damera-Venkata, N., et al., 2009, Display supersampling, ACM Transactions on Graphics (TOG) vol. 28 Issue 1, Article No. 9, ACM New York, NY, USA, Jan. 2009.
Damera-Venkata, N., et al., 2007, On the Resolution Limits of Superimposed Projection, IEEE International Conference on Image Processing, 2007, vol. 5, pp. 373-376, 2007.
Didyk, P., et al., 2010, Apparent display resolution enhancement for moving images, ACM Transactions on Graphics (TOG)—Proceedings of ACM SIGGRAPH 2010, vol. 29 Issue 4, Article No. 113, ACM New York, NY, USA, Jul. 2010.
Grosse, M., et al., 2010, Coded aperture projection, ACM Transactions on Graphics (TOG) vol. 29 Issue 3, Article No. 22, ACM New York, NY, USA, Jun. 2010.
Heide, F., et al., 2013, Adaptive image synthesis for compressive displays, ACM Transactions on Graphics (TOG)—SIGGRAPH 2013 Conference Proceedings, vol. 32 Issue 4, Article No. 132, ACM New York, NY, USA, Jul. 2013.
Izadi, S., et al., 2008, Going beyond the display: a surface technology with an electronically switchable diffuser, UIST '08, Proceedings of the 21st annual ACM symposium on User interface software and technology, pp. 269-278, ACM New York, NY, USA, 2008.
Lanman, D., et al., 2010, Content-adaptive parallax barriers: optimizing dual-layer 3D displays using low-rank light field factorization, ACM Transactions on Graphics (TOG)—Proceedings of ACM SIGGRAPHh Asia 2010, vol. 29 Issue 6, Article No. 163, ACM New York, NY, USA, Dec. 2010.
Lanman, D., et al., 2011, Polarization Fields: Dynamic Light Field Display using Multi-Layer LCDs, ACM Trans. Graph. (SIGGRAPH Asia), 30, 6.
Sajadi, B., et al., 2012, Edge-guided resolution enhancement in projectors via optical pixel sharing, ACM Transactions on Graphics (TOG)—SIGGRAPH 2012 Conference Proceedings, vol. 31 Issue 4, Article No. 79, ACM New York, NY, USA, Jul. 2012.
Seetzen, H., et al., 2004, High dynamic range display systems, ACM Transactions on Graphics (TOG)—Proceedings of ACM SIGGRAPH 2004, vol. 23 Issue 3, pp. 760-768, ACM New York, NY, USA, Aug. 2004.
Wetzstein, G., et al., 2011, Layered 3D: Tomographic Image Synthesis for Attenuation-based Light Field and High Dynamic Range Displays, ACM Trans. Graph. (SIGGRAPH), 30, 4.
Wetzstein, G., et al., 2012, Tensor Displays: Compressive Light Field Synthesis using MultiLayer Displays with Directional Backlighting, ACM Trans. Graph. (SIGGRAPH), 31, 4.

* cited by examiner

METHODS AND APPARATUS FOR VISUAL DISPLAY

RELATED APPLICATIONS

This application is a non-provisional of, and claims the benefit of the filing date of, U.S. Provisional Patent Application No. 61/862,295, filed Aug. 5, 2014, the entire disclosure of which is herein incorporated by reference.

FIELD OF THE TECHNOLOGY

The present invention relates generally to visual displays.

SUMMARY

In exemplary implementations of this invention, two high-speed liquid crystal displays (LCDs) are mounted, with a slight offset, on top of each other. Processors perform calculations to decompose a target high-resolution image into a one or more pairs of patterns. For each pair, one pattern is shown on the front LCD and the other pattern is shown on the rear LCD. If multiple pairs exist, the pairs are shown in quick succession. Compared to the native resolution of each LCD panel, the compressive superresolution display achieves significant improvements in resolution.

In exemplary implementations, a diffuser covers the LCD closest to the observer. The effect of the diffuser is to combine the respective light contributions of the two panels into a single superresolved, two-dimensional image. The two stacked LCDs synthesize an intermediate light field inside the device; the diffuser then integrates the different views of that light field such that an observer perceives a superresolved, two-dimensional image. One or more processors perform a nonlinear convex optimization algorithm in order to compute the patterns displayed by the two stacked LCDs.

In exemplary implementations, one or more processors perform a splitting algorithm to compute optimal pixel states from a target high-resolution image. In effect, the display pixels present a compressed representation of the target image that is perceived as a single, high-resolution image.

In some cases, the diffuser may be electronically switchable. If the diffuser is switched on, the display device operates in superresolution image display mode. If the diffuser is switched off, the display device operates in a glasses-free 3D or a high dynamic range display mode.

In some implementations, light from a backlight is transmitted through two stacked LCDs and then through a diffuser. The front side of the diffuser displays a time-varying sequence of 2D images. Processors execute an optimization algorithm to compute optimal pixel states in the first and second LCDs, respectively, such that for each respective image in the sequence, the optimal pixel states minimize, subject to one or more constraints, a difference between a target high-resolution image and the respective image. The processors output signals to control actual pixel states in the LCDs, based on the computed optimal pixel states. The 2D images displayed by the diffuser have a higher spatial resolution than the spatial resolution of the LCDs.

In exemplary implementations, the two LCDs function as a light field display that projects a light field on the rear side of the diffuser. Alternatively, in some cases, other types of light field displays are used. For example, the light field display (which projects a light field on the rear of the diffuser) may comprise a single LCD and a microlens array.

In some implementations, other types of angle-averaging screens are used, instead of the front diffuser. For example, in some cases, the angle-averaging screen comprises a microlens array or a holographic optical element (HOE).

In exemplary implementations, the target high-resolution image is an image captured by a digital camera, or created by a computer program, or rendered using computer graphic techniques.

The description of the present invention in the Summary and Abstract sections hereof is just a summary. It is intended only to give a general introduction to some illustrative implementations of this invention. It does not describe all of the details of this invention. This invention may be implemented in many other ways. Likewise, the description of this invention in the Field of the Technology section is not limiting; instead it identifies, in a general, non-exclusive manner, a field of technology to which exemplary implementations of this invention generally relate.

The above Figures show some illustrative implementations of this invention, or provide information that relates to those implementations. However, this invention may be implemented in many other ways.

DETAILED DESCRIPTION

Optical Image Formation:

In exemplary implementations, a light field display device located behind a diffuser projects a light field onto the rear side of the diffuser.

The image i(x) observed on the diffuser is a projection of the incident light field l(x, v) over the angular domain $\Omega_v$:

$$i(x)=\int_{\Omega_v} l(x,v)dv. \quad (1)$$

Here, x is the 2D spatial coordinate on the diffuser and v denotes the angle. The light field absorbs angle-dependent integration weights of the diffuser. In the following discussion, a relative two-plane parameterization of the light field is employed. (That is, a light ray in the light field is parameterized by the spatial coordinates of the point where the ray intersects a first plane and the spatial coordinates of the point where the ray intersects a second plane. The second plane is displaced from and parallel to the first plane. If the point in the first plane and the point in the second plane are each specified by 2D (e.g., x, y) spatial coordinates, then the light field is sometimes referred to as a 4D light field. Alternatively, a light field, including a 4D light field, may be parameterized in other ways.)

Figure 1A:
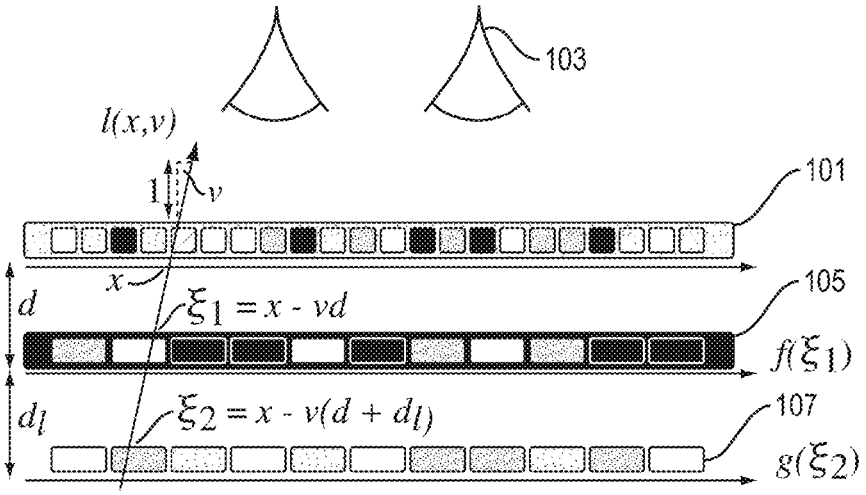
FIG. 1A is a conceptual diagram of two stacked LCDs projecting a light field on a diffuser.

In exemplary implementations, the light field display device comprises two stacked liquid crystal displays (LCDs). Driven at a speed beyond the critical flicker frequency of the human visual system (HVS), an observer perceives the temporal integral of the sets of patterns shown on the display. The light field that is synthesized inside the display and incident on the diffuser is $$\tilde{l}(x, v) = \frac{1}{K}\sum_{k=1}^{K} f^{(k)}(x - d\cdot v)\cdot g^{(k)}(x - (d + d_l)\cdot v) \tag{2}$$

where d is the distance between diffuser and front LCD panel and $d_l$ is the distance between front and rear LCD panels (as shown in FIG. 1A). The spatial coordinates on the panels are denoted by $\xi$ whereas the functions $f(\xi_1)$ and $g(\xi_2)$ give the transmittance of front and rear panel at each position.

The LCD panels run at a frame rate that is K times faster than the HVS. The emitted light field of any pair of LCD patterns corresponds to their outer product and is therefore rank-1. The light field observed from the high-speed LCD panels $\tilde{l}(x,v)$ is rank-K due to the retinal integration of K rank-1 light fields. Combining Equations 1 and 2 results in the following expression for the image observed on the diffuser $$\begin{aligned}\tilde{i}(x) &= \int_{\Omega_v} \frac{1}{K}\sum_{k=1}^{K} (f^{(k)}(x - d\cdot v)\cdot g^{(k)}(x - (d + d_l)\cdot v))dv \\ &= \frac{1}{K}\sum_{k=1}^{K}\int\int \phi(x - \xi_1, x - \xi_2)(f^{(k)}(\xi_1)\cdot g^{(k)}(\xi_2))d\xi_{1,2}\end{aligned} \tag{3}$$

Equation 3 shows that each location on the diffuser integrates over some area on front and rear LCD. This integration is modeled as a convolution with a 4D kernel $\phi$. For an infinitely small point x on the diffuser, the kernel is $$\phi(\xi_1, \xi_2) = \mathrm{rect}(\xi_1/s_1)\mathrm{rect}(\xi_2/s_2)\delta\left(\xi_2 - \frac{s_2}{s_1}\xi_1\right) \tag{4}$$

where $s_{1,2}$ represent the spatial extent of the diffused point on the front and rear panel, respectively, and rect(•) is the rectangular function.

These sizes ($s_{1,2}$) depend on the distance $d_l$ between the LCD panel, the distance d between the front LCD panel and diffuser, and the angular diffusion profile of the diffuser (see FIG. 1A). In practice, the integration areas of each superresolved pixel are calibrated for a particular display configuration. Discretizing Equation 3 results in $$i = P\mathrm{vec}(FG^T) \tag{5}$$

Here, the K time-varying patterns of front and rear LCD panels are encoded in the columns of matrices $F\in\mathbb{R}^{M\times K}$ and $G\in\mathbb{R}^{M\times K}$, respectively. The resolution of the observed image $i\in\mathbb{R}^{N}$ is larger than that of either LCD panel, i.e. $N\geq M$. The convolution kernel is encoded in a matrix $P\in\mathbb{R}^{N\times M^2}$ and vec( ) is a linear operator that reshapes a matrix into a vector by stacking up its rows.

Figure 1B:
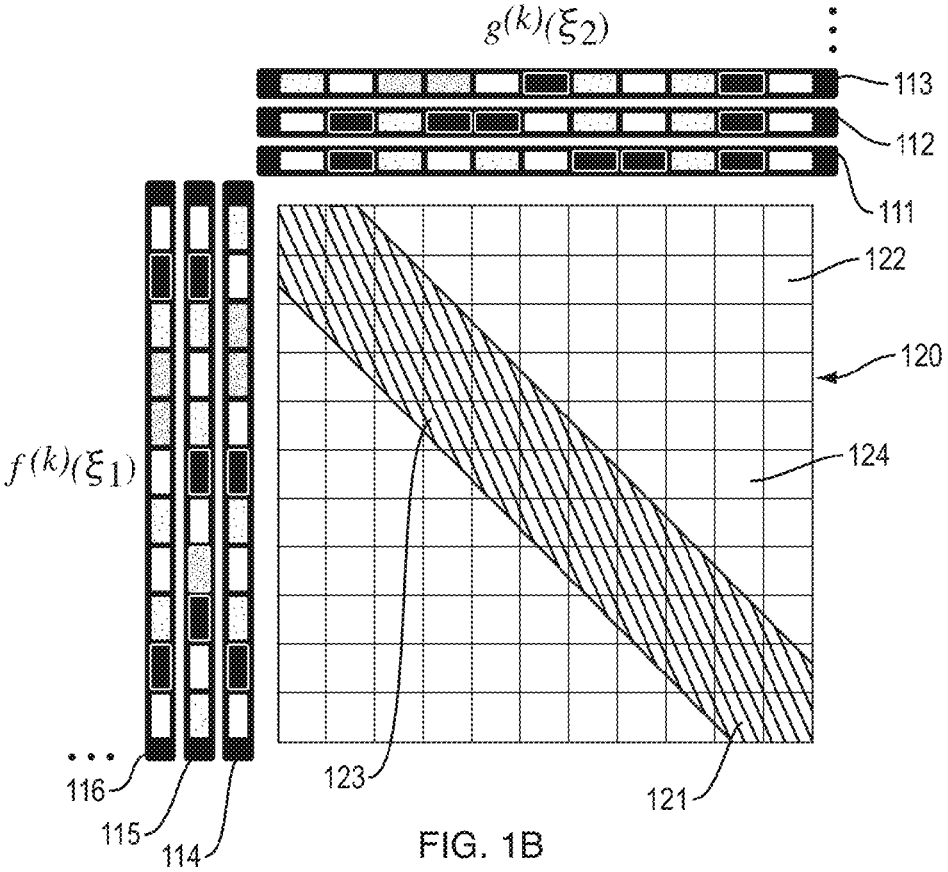
FIG. 1B is a conceptual diagram of the combined effect of the images displayed on the two stacked LCDs.

FIG. 1A is a conceptual diagram of two stacked LCDs projecting a light field onto a diffuser. FIG. 1B is a conceptual diagram of the combined effect of the images displayed on the two stacked LCDs.

In the example shown in FIGS. 1A and 1B, a diffuser 101 is directly observed by a human viewer 103 and optically transforms a 4D light field into a superresolved 2D image. The 4D light field is emitted by two high-speed LCD panels 105, 107. Optically, the two LCD panels 105, 107 have the combined effect of projecting a light field that is mathematically modelled by integration in which the integrand is the outer product of $f(\xi_1)$ and $g(\xi_2)$. The pixels on the diffuser have a resolution exceeding that of either LCD panel.

FIG. 1B is a conceptual diagram that illustrates (a) the low-rank light field matrix emitted by the two LCD display layers 111, 114 and (b) integration areas of the superresolved pixels. Although each of these integration areas is smaller than the regular grid cells of light rays spanned by the display, the superresolved pixels are not aligned with the grid and each diffuser pixel receives contributions from multiple different rays, allowing for superresolution image synthesis.

In FIG. 1B, the size of the grid cells (e.g., 122, 124) in the grid 120 conceptually illustrates the resolution of the light field created by the two LCDs (which is usually the same as the resolution of the LCDs). The resolution of the light field is limited by the resolution of the individual LCDs 111, 114 and is much coarser than the resolution of the synthesized superresolved 2D image that is perceived by a human observing the front side of the diffuser.

In FIG. 1B, each overlaid cell (e.g., 121, 123) conceptually represents a single 2D pixel of the super-resolution 2D image that is perceived by a human observing the front side of the diffuser. Each of these cells (of the superresolution 2D image) is effected by multiple lower-resolution light field cells.

In FIG. 1B, three copies of each LCD panel are shown (111, 112, 113 for one LCD panel and 114, 115, 116 for the other LCD). For each respective LCD, these three copies conceptually represent three time-multiplexed patterns (for example, three time-multiplexed images displayed by a 180 Hz LCD with the human visual system resolving only 60 Hz).

FIG. 1B conceptually illustrates that the diffuser pixels are smaller than the LCD pixels. (Otherwise there would be no superresolution effect). In exemplary implementations, the area of the diffuser is as large as the area of each of the LCDs.

Superresolution Image Synthesis:

Given a target high-resolution image i and the image formation derived in the last subsection, an objective function that minimizes the $l_2$-norm between target and emitted image given physical constraints of the pixel states $$\begin{aligned}\underset{\{F,G\}}{\text{minimize}} \quad & \|i - P\mathrm{vec}(FG^T)\|_2^2 \\ \text{s.t.} \quad & 0 \leq F, G \leq 1\end{aligned} \tag{6}$$

where (a) i is a target high-resolution image, (b) the columns of matrices $F\in\mathbb{R}^{M\times K}$ and $G\in\mathbb{R}^{M\times K}$ encode K time-varying patterns of front and rear LCD panels, respectively, (c) matrix $P\in\mathbb{R}^{N\times M^2}$ encodes a 4D convolution kernel $\phi$ that models integration of each location on the diffuser over some area on the front and rear LCD panels; and (d) vec ( ) is a linear operator that reshapes a matrix into a vector.

This objective function (i.e., Equation 6) is difficult to deal with, as it involves a large matrix factorization embedded within a deconvolution problem. To make the problem manageable, this objective function (i.e., Equation 6) is split using the intermediate light field l produced by the display as a splitting variable $$\begin{aligned}\underset{\{F,G\}}{\text{minimize}} \quad & \|FG^T - i\mathrm{vec}(I)\|_F^2 \\ \text{s.t.} \quad & P1 = i, 0 \leq 1 \\ & 0 \leq F, G \leq 1\end{aligned} \tag{7}$$

Here, ivec( ) is a linear operator reshaping the vector into a matrix, and the Frobenius norm $\|\cdot\|_F^2$ measures the sum of squared differences of all matrix elements. Although the objective function is non-convex, it is convex with respect to each individual variable F,G,l with the other two fixed. The first constraint is affine in l, an additional slack variable that splits the matrix factorization from the linear operator, while both are still coupled via the added consensus constraint. In some implementations, Equation 7 is solved using the alternating direction method of multipliers (ADMM). First, the augmented Lagrangian is calculated:

$$\mathcal{L}_\rho(F, G, 1, \lambda) = \|FG^T - ivec(1)\|_F^2 + \lambda^T(P1 - i) + \frac{\rho}{2}\|P1 - i\|_2^2, \quad \text{s.t. } 0 \le 1 \wedge 0 \le F, G \le 1 \tag{8}$$

where λ is a dual variable associated with the consensus constraint.

In ADMM $\mathcal{L}_\rho(F,G,l,\lambda)$ is minimized with respect to one variable while fixing the other primal and dual variables. The dual variable is then the scaled sum of the consensus constraint error. In some implementations of this invention, the minimization of the augmented Lagrangian in each step leads to the following algorithm:

$$\begin{aligned} 1 &\leftarrow \underset{\{1\}}{\operatorname{argmin}} \mathcal{L}_\rho(F, G, 1, \lambda) = \underset{\{1\}}{\operatorname{argmin}} \|FG^T - ivec(1)\|_F^2 + \rho\|P1 - i + u\|_2^2 \\ &\text{s.t. } 0 \le 1 \\ \{F, G\} &\leftarrow \underset{\{F,G\}}{\operatorname{argmin}} \mathcal{L}_\rho(F, G, 1, \lambda) = \underset{\{F,G\}}{\operatorname{argmin}} \|FG^T - ivec(1)\|_F^2 \\ &\text{s.t. } 0 \le F, G \le 1 \\ u &\leftarrow u + (P1 - i) \end{aligned} \tag{9}$$

where u=1/ρ*λ is a substitution that simplifies the notation.

Using ADMM allows Equation 6 to be transformed into a sequence of simpler subproblems. The first step of Equation 9 is a deconvolution problem, while the second step is a matrix factorization problem. These two subproblems (deconvolution and matrix factorization) can be solved in a variety of ways. For example, as described in more detail below, the deconvolution subproblem can be solved using SART, and the matrix factorization problem can solved using non-negative iterative update rules.

In some implementations, the non-negative matrix factorization problem is bi-convex, meaning convergence is not guaranteed. However, in these implementations, the algorithm in practice produces high quality results in spite of a lack of theoretical guarantees.

Advantageously, Equation 6 is easily modified to apply to other light field display devices (that do not comprise two stacked LCDs): in some cases, the only modification required would be to change the second term in the objective function in Equation 6, such that the second term is replaced with the appropriate image formation and inversion model.

Deconvolution Subproblem:

In some implementations, the deconvolution sub-problem is solved using a Simultaneous Algebraic Reconstruction Technique (SART) algorithm. Advantageously, the SART algorithm converges faster to nicer solutions than simple gradient descent or the conjugate gradient method due to the scaling by row and column sums of P.

In these implementations, SART is applied to each term of the first subproblem in Equation 9, shown slightly rewritten below:

$$\underset{\{1\}}{\operatorname{argmin}} \|1 - vec(FG^T)\|_2^2 + \rho\|P1 - (i - u)\|_2^2 \quad \text{s.t. } 0 \le 1 \tag{10}$$

Applying a SART iteration to Equation 10 gives the following iterative update rule for the auxiliary light field variable l:

$$l^{k+1} = l^k - w(l^k - \text{vec}(FG^T)) - wV^{-1}P^TW^{-1}(Pl^k - (i-u)) \tag{11}$$

where w∈[0,2], and V&W are diagonal matrices with entries $$V_{j,j} = \sum_i P_{i,j} \text{ and } W_{i,i} = \sum_j P_{i,j}.$$

Following each iteration the entries of $l^{k+1}$ are clamped to be positive.

Matrix Factorization Subproblem:

In some implementations, to solve the matrix factorization subproblem, F and G are initialized with uniform random values and then non-negative iterative update rules are applied. Defining L=ivec(l), these are:

$$F \leftarrow F \circ \frac{(W \circ L)G}{W \circ (FG^T)G} \qquad G \leftarrow G \circ \left(\frac{F^T(W \circ L)}{F^T(W \circ (FG^T))}\right)^T \tag{12}$$

where the quotients are performed component-wise, ∘ denotes the component-wise product and W is a weighting matrix that is zero everywhere except for pairs of front and rear layer pixels that define rays at an angle of no more than a specified number of degrees with respect to the optical axis.

For example, in an illustrative implementation, the specified number of degrees is chosen to be 7.5 degrees, based on the shoulder width of the diffuser point spread function (PSF). However, the specified number of degrees may be any number.

Figure 2:
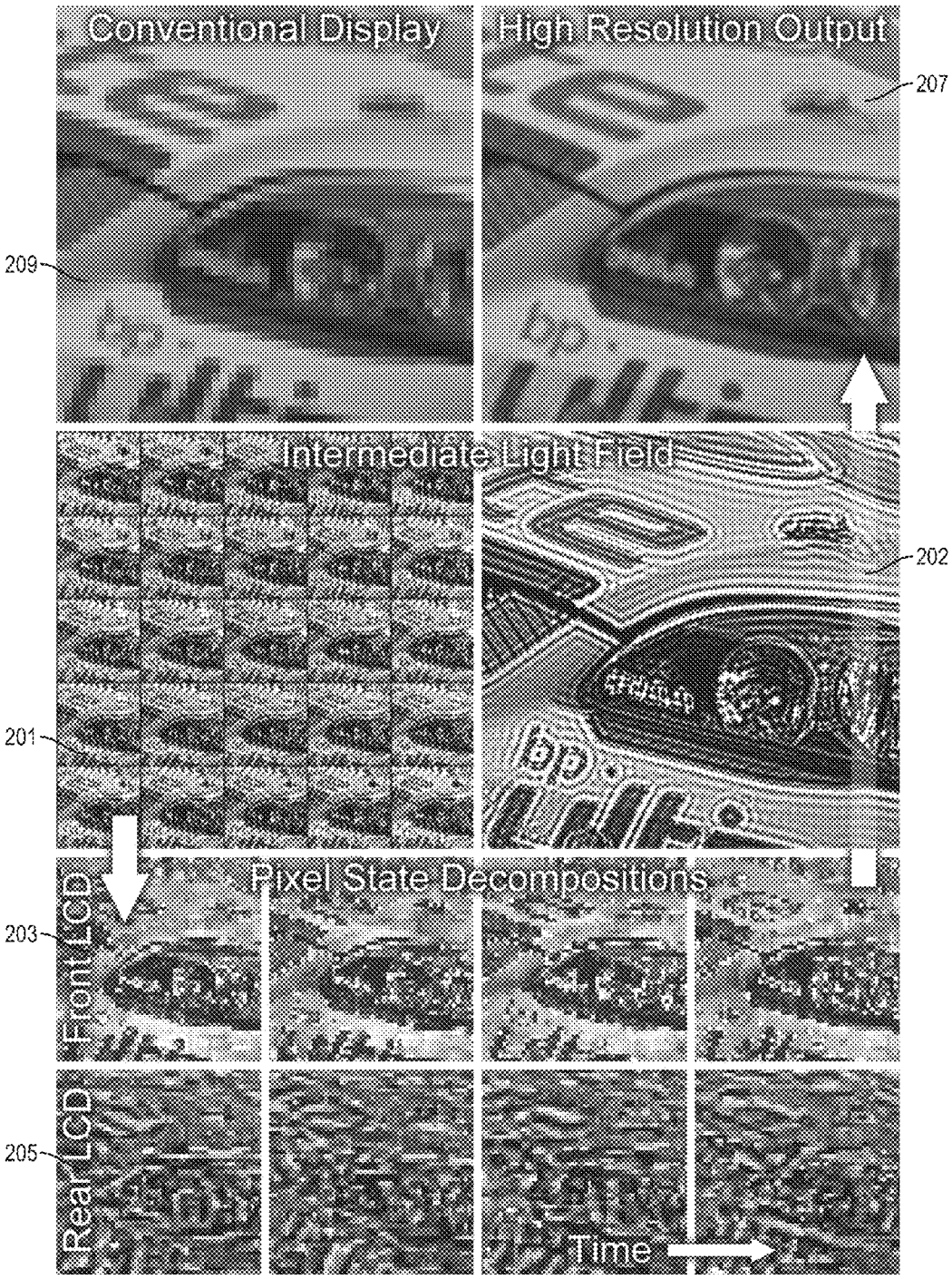
FIG. 2 shows an example of superresolution image decomposition.

More Details:

FIG. 2 shows an example of superresolution image decomposition, in an illustrative implementation of this invention. One or more processors perform an algorithm to decompose a target high-resolution image (not shown) into an intermediate light field, and then to compute optimal pixel states. The intermediate light field has an angular resolution of 5×5 views 201, where the number of views directly corresponds to the desired increase in resolution compared to the native resolution of the LCD panels. The processors reorder and show the light field such that each 5×5 pixel block in the image contains all angular samples for a single spatial region of the scene being imaged. A close-up of one view (out of the 25 views in the 5×5 views) is shown at 202. The intermediate light field concentrates high frequency features around the edges of a higher resolution image, which are optically combined by the diffuser. The patterns displayed on the front and rear LCD panels are shown in rows 203 and 205, respectively. The patterns in rows 203, 205 are the optimal pixel states computed by the processors. Different patterns are displayed at different times. For example, the front LCD panel displays, at different times, the first, second, third, and fourth display patterns shown in row 203. Also, for example, the rear LCD panel displays, at different times, the first, second, third, and fourth display patterns shown in row 205. The algorithm employs a rank-4 decomposition that assumes a critical flicker frequency of 30 Hz for the employed 120 Hz panels. The patterns contain extremely high frequency content that varies over the two LCDs and also over time. When the patterns are displayed on the LCDs at a high speed on the device, an observer sees (when looking at the diffuser) an image 207 that has a significantly higher resolution than an image 209 at the native resolution of one of the LCD panels.

In illustrative implementations, uniform regions in the target image receive relatively uniform intensity contributions from all incident light field directions. Near edges, however, the contrast is increased by adding and removing energy from angles that can resolve those edges. The light field projection onto the diffuser integrates the angles and, hence, blurs the angular light field variation into a single image.

FIGS. 3, 4, 5A and 5B each, respectively, show steps in an algorithm for a superresolution display, in illustrative implementations of this invention.

Figure 3:
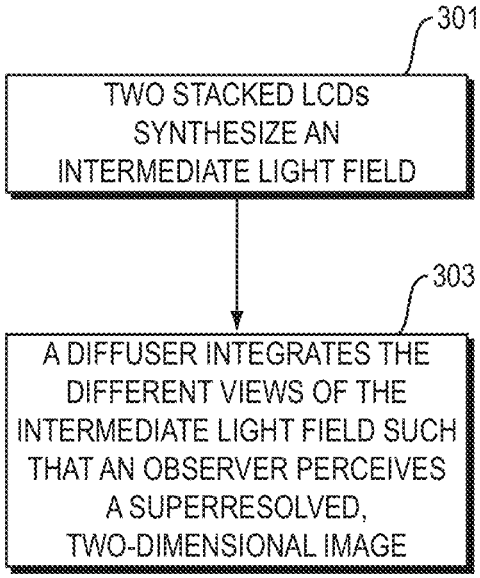
FIGS. 3, 4, 5A and 5B each show steps in an algorithm for a superresolution display.

As shown in FIG. 3, in some cases: Two stacked LCDs synthesize an intermediate light field 301. A diffuser integrates the different views of the intermediate light field such that an observer perceives a superresolved, two-dimensional image 303.

Figure 4:
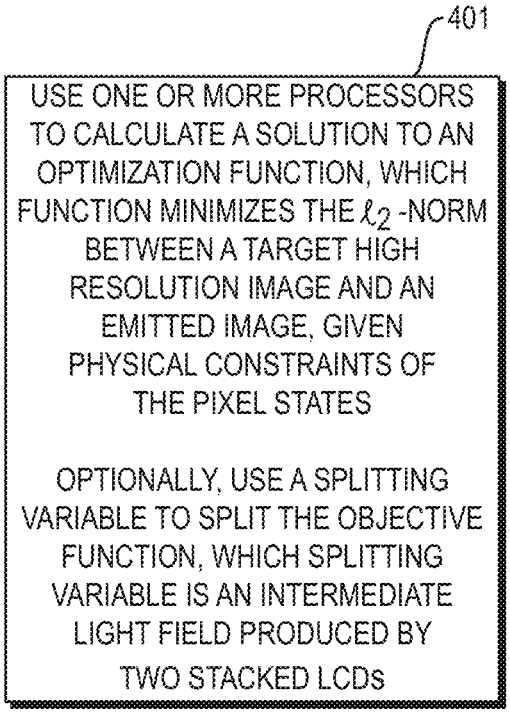

As shown in FIG. 4, in some cases the algorithm comprises the following steps: Use one or more processors to calculate a solution to an optimization function, which function minimizes the $l_2$-norm between a target high-resolution image i and an emitted image, given physical constraints of the pixel states. Optionally, use a splitting variable to split the objective function, which splitting variable is an intermediate light field produced by two stacked LCDs 401.

Figure 5A:
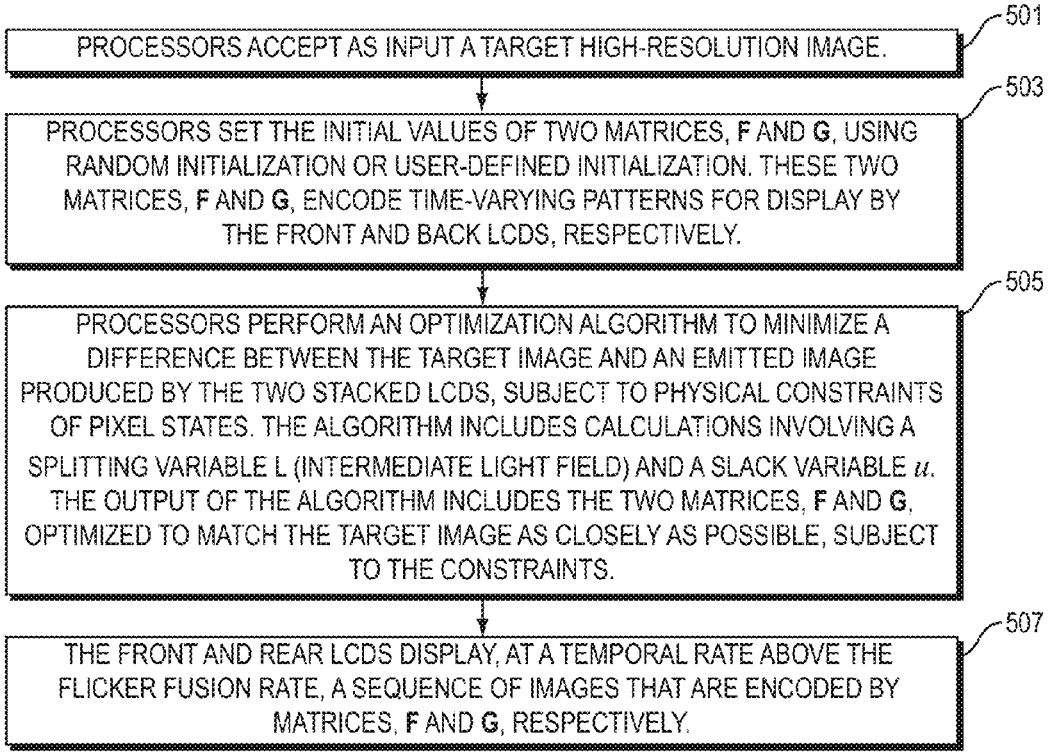

As shown in FIG. 5A, in some cases the algorithm comprises the following steps: Processors accept as input a target high-resolution image 501. Processors set the initial values of two matrices, F and G, using random initialization or user-defined initialization. These two matrices, F and G, encode time-varying patterns for display by the front and back LCDs, respectively 503. Processors perform an optimization algorithm to minimize a difference between the target image and an emitted image produced by the two stacked LCDs, subject to physical constraints of pixel states. The algorithm includes calculations involving a splitting variable L (intermediate light field) and a slack variable u. The output of the algorithm includes the two matrices, F and G, optimized to match the target image as closely as possible subject to the constraints 505. The front and back LCDs display, at a temporal rate above the flicker fusion rate, a sequence of images that are encoded by matrices F and G, respectively 507.

Figure 5B:
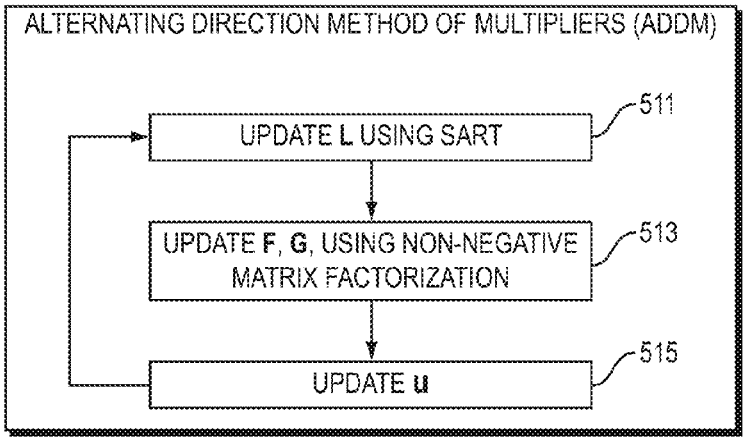

As shown in FIG. 5B, in some cases processors execute an ADMM algorithm that includes a loop, where each iteration of the loop includes the following steps: Update L using SART 511. Update F, G, using non-negative matrix factorization in accordance with multiplicative update rules 513. Update u 515.

Prototype:

The following is a description of a prototype of this invention:

In a prototype implementation of this invention, two high-speed LCDs are used. The LCDs are modified Viewsonic® VX2268wm 120 Hz panels. All diffusing and polarizing films are removed from the front panel. The front-most (diffusing) polarizer is replaced by a clear linear polarizer. The LCD panels are mounted on a rail system, and their position is adjusted via the rail system such that the LCD panels have a spacing of 19 mm between them. The rear panel has an unmodified backlight that illuminates both LCD layers. The diffuser is fixed to a frame that is also mounted on the rail system; the position of the diffuser is adjusted via the rail system such that the diffuser is mounted at a distance of 6 mm from the front LCD.

The prototype is controlled by a 3.4 GHz Intel Core® i7 workstation with 4 GB of RAM. A four-head NVIDIA Quadro® NVS 450 graphics card synchronizes the two displays and an additional external monitor. With the diffuser in place, the display functions in superresolution mode using content generated by the algorithm described above (Equations 7 to 9). With the diffuser removed (or electronically switched off), the display functions in glasses-free 3D or high dynamic range modes.

For this prototype, calibration steps are performed to calibrate (a) display gamma curves, (b) geometric alignment of the LCD panels, and (c) diffuser point spread function (PSF). First, gamma curves are calibrated using standard techniques: uniform images with varying intensities are shown on the display and captured with a linearized camera in RAW format. The acquired curves are inverted in real-time when displaying decomposed patterns. The display black level is incorporated as a constraint into the nonnegative matrix factorization routine. Second, the front and rear LCDs are geometrically registered. For this purpose, LCD panels are aligned mechanically as best as possible and possible misalignments are fine-tuned in software. With the diffuser removed, crossbars are shown on both screens that are aligned for the perspective of a calibration camera. Third, the point spread function (PSF) of the diffuser is measured by displaying white pixels on a uniform grid on the front LCD panel, with the rear LCD panel fully illuminated. The PSFs are then extracted from linearized RAW photographs of the prototype by extracting areas around the according grid positions. The PSFs measured on the prototype are approximately uniform over the display surface, hence all PSFs are averaged and a spatially-invariant PSF is used in the computational routines. A calibrated PSF captured in this prototype is well modeled as a rotationally-symmetric angular cosine function with a field of view of 15 degrees.

In this prototype, the algorithm for Equation 9 is implemented in Matlab®. The matrix factorization subproblem is solved in C++ with the linear algebra library Eigen and is interfaced by the solver via a MEX wrapper. The deblurring problem is solved independently for each color channel using Bregman iterations, implemented in parallel in Matlab®. The pixel states for F,G are initialized with random values. The parameter $\lambda$ in Equation 9 is 0.01, U is initialized as 0. In this prototype, a rank-4 decomposition for a target image with a resolution of 1575×1050 pixels into 315×210 pixel LCD patterns (5× superresolution) takes 3.7 minutes.

This invention is not limited to the above-described prototype. Instead, this invention can be implemented in many different ways.

Figure 6:
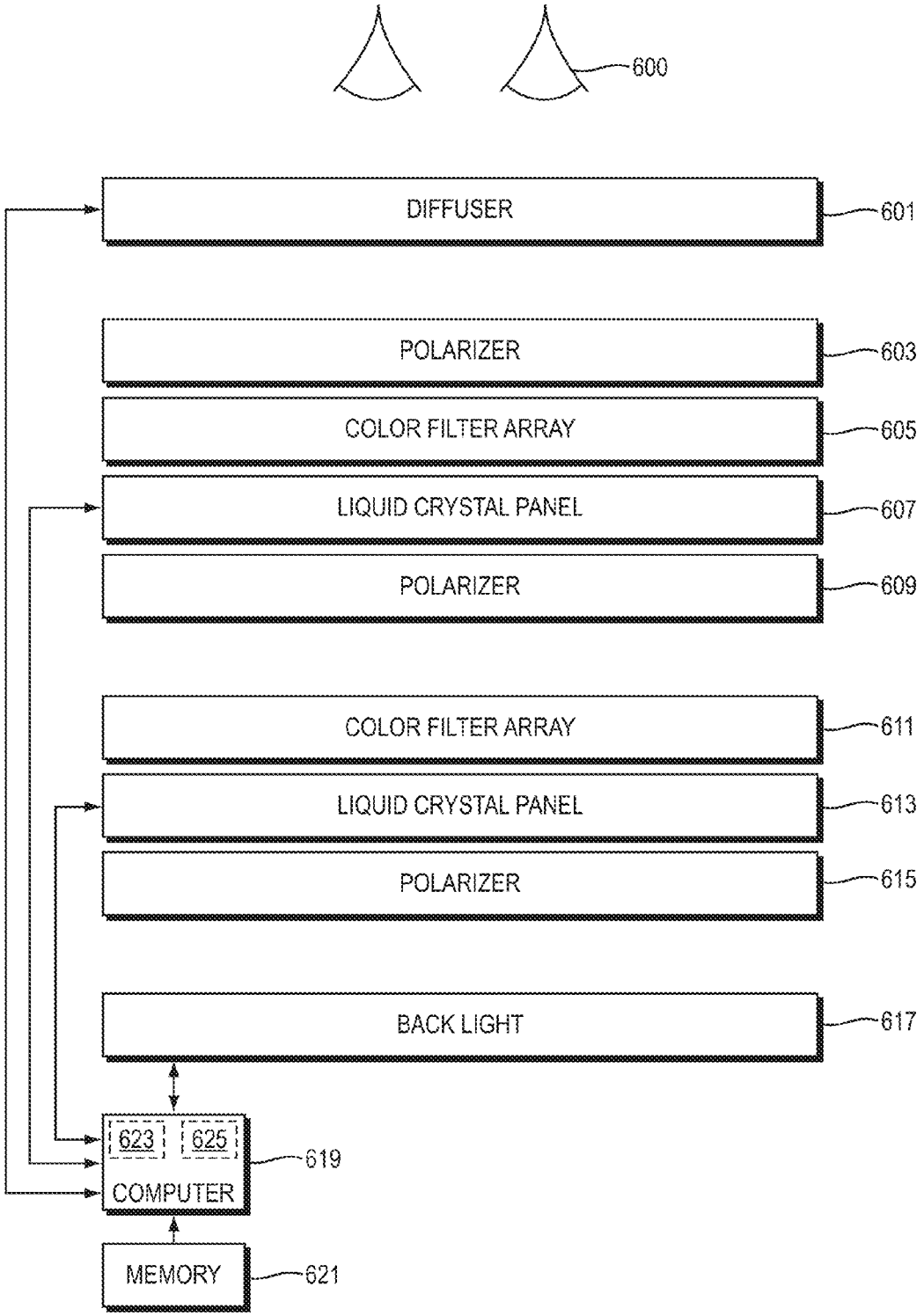
FIGS. 6 and 7 each show hardware components of a superresolution display.
Figure 7:
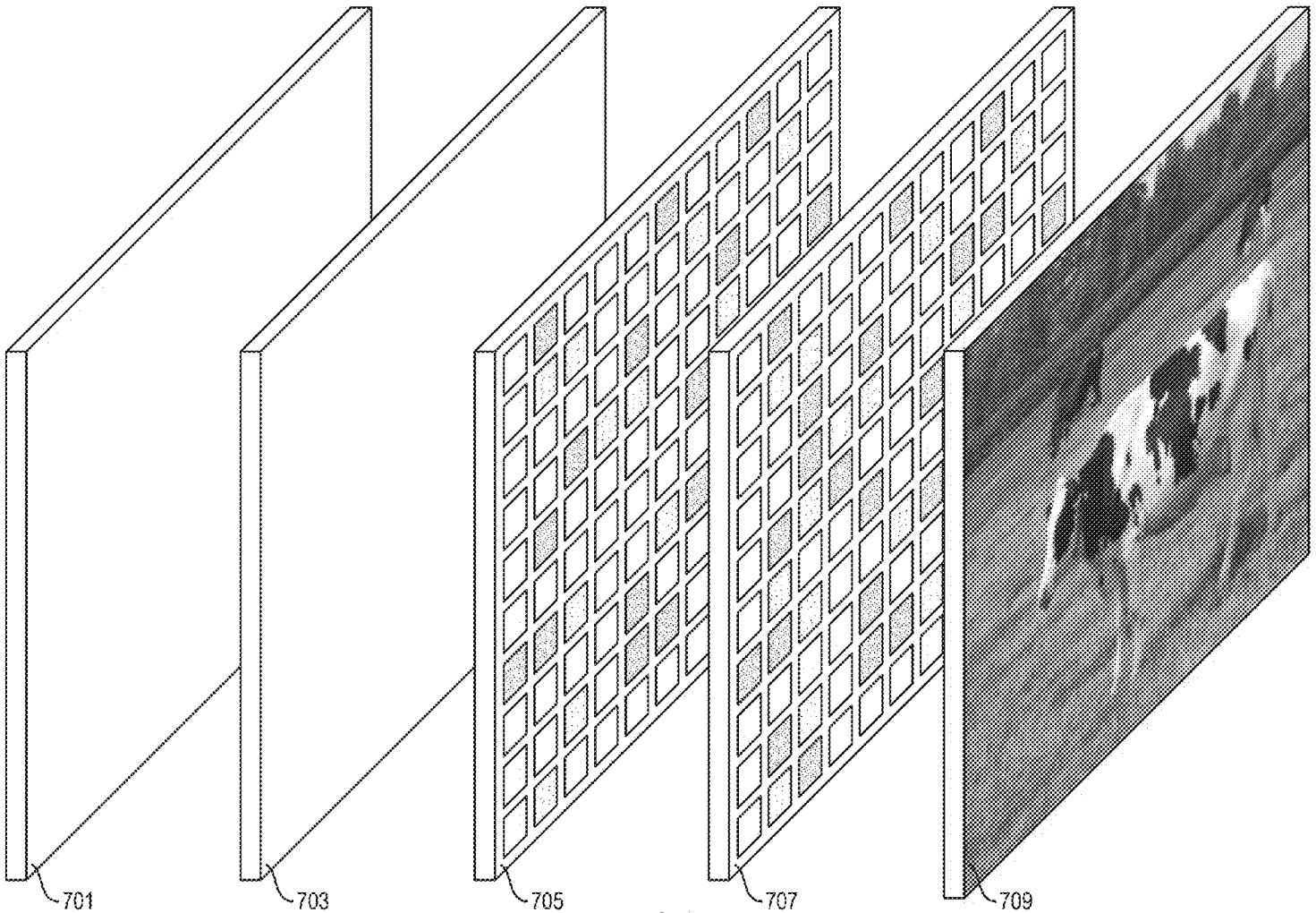

Hardware:

FIGS. 6 and 7 each show hardware components of a superresolution display, in illustrative implementations of this invention.

In the example shown in FIG. 6: The superresolution display comprises a uniform backlight 617, two LCDs and a front diffuser 601. The front diffuser 601 is directly observed by a human observer 600. The front LCD comprises (from front to back) a polarizing layer 603, color filter array 605, liquid crystal panel 607, and polarizing layer 609. The rear LCD comprises (from front to back) a color filter array 611, liquid crystal panel 613 and a polarizing layer 615. One or more processors (e.g., 623, 625) in a computer 619 are used to control the operation of the display, including controlling pixel states for each pixel in the front and rear LCDs, respectively. For example, in some cases, the processors 623, 625 control the front and rear LCDs to display a temporal sequence of images. An electronic memory device 621 is used to store digital data. The color filter arrays 605, 611 are optional.

In the example shown in FIG. 7: Light from a backlight 701 passes through a light-shaping layer 703, then through a rear spatial light modulator (SLM) 705, then through a front SLM 707, and then through the front diffuser 709. The front diffuser displays a superresolution image. In the example shown in FIG. 7, that superresolution image shows a cow. The light-shaping layer 703 transforms the light from the backlight such that when the light exits the light-shaping layer 703, the light is spatially and angularly uniform. In some cases, the light-shaping layer 703 comprises a film or other layer, such as prisms, microlenses, diffusers, or any apparatus that makes light emitted by a backlight spatially and angularly uniform. In some cases, the SLMs 705, 707 are LCDs.

Additional Display Modes:

In exemplary implementations, the display device includes a switch (e.g., an electronic switch) for turning the front diffuser (e.g., 101, 601, 709) in the display device on and off.

When the front diffuser is switched on (activated), the display device operates in a superresolution mode, and displays superresolved 2D images.

When the front diffuser is switched off (deactivated), the diffuser becomes transparent and the display device operates in other display modes. In some cases, when the diffuser is switched off, the device operates in an automultiscopic mode (in which it produces a glasses-free 3D display) or in a high contrast mode (in which it displays a high dynamic range image).

In the high contrast mode, the algorithm performed by the processors (to compute the time-varying displays of the front and rear LCDs) is modified. For example, in some cases, for high contrast mode, Equation 6 is modified by replacing the zero (in the constraint $0 \leq F, G \leq 1$) with the blacklight of the LCD panels. For example, if the blacklight of the LCD panels is 0.1, then the constraint in Equation 6 would be modified to read $0.1 \leq F, G \leq 1$. In the high contrast mode, the display device displays a 2D image (on the front side of the diffuser) with an increased dynamic range compared to the maximum available dynamic range on either of the LCDs.

Likewise, in the automultiscopic mode, the algorithms performed by the processors (to compute the time-varying displays of the front and rear LCDs) are modified. For example, in some cases for automultiscopic mode, the processors perform algorithms (including non-negative tensor factorization) described in Wetzstein et al, Tensor Displays, U.S. Patent Publication US 2014-0063077 A1. In the automultiscopic mode, the display device produces an automultiscopic display.

In both the high contrast mode and the automultiscopic mode, the front diffuser (e.g. 101, 601,709) in the display device is switched off, deactivated and transparent.

Figure 8:
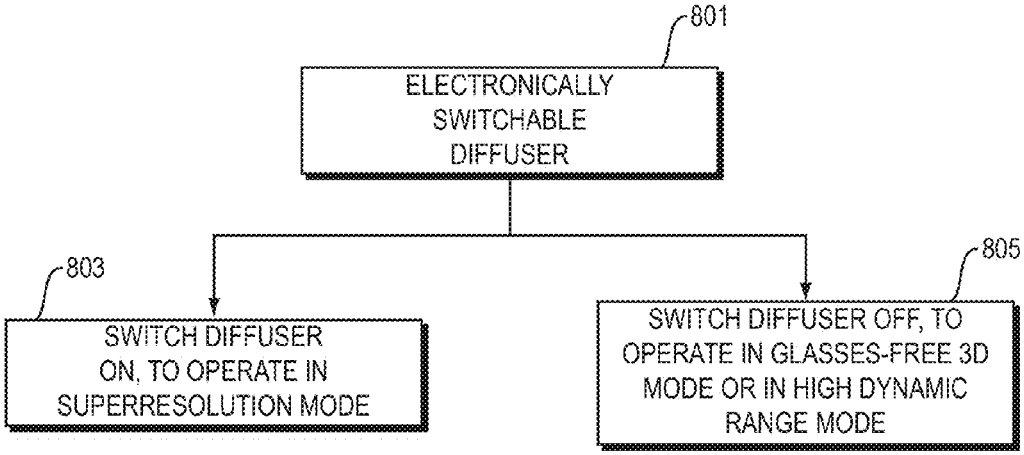
FIG. 8 shows a device which operates in different modes, depending in part on the state of an electronically switchable diffuser.

In the example shown in FIG. 8, a display device operates in different modes, depending in part on the state of an electronically switchable diffuser 801. If the diffuser is switched on, the device operates in superresolution mode 803. If the diffuser is switched off (and thus is transparent), the device operates in either glasses-free 3D mode or in high dynamic range mode 805.

Processors:

In exemplary implementations of this invention, one or more electronic processors are specially adapted: (1) to control the operation of, or interface with, hardware components of a display device, including any LCD or other spatial light modulator (SLM), an electronically switchable diffuser and a backlight, (2) to calculate an intermediate light field produced by two LCDs or other spatial light modulators; (3) to perform calculations to execute an ADMM algorithm, a SART algorithm, or non-negative matrix factorization in accordance with multiplicative update rules; (4) to perform an optimization algorithm to calculate pixel states for time-varying patterns displayed by front and rear LCDs (or front and rear SLMs); (5) to receive signals indicative of human input, (6) to output signals for controlling transducers for outputting information in human perceivable format, and (7) to process data, to perform computations, to execute any algorithm or software, and to control the read or write of data to and from memory devices. The one or more processors may be located in any position or positions within or outside of the display device. For example: (a) at least some of the one or more processors may be embedded within or housed together with other components of the display device, such as the LCDs or SLMs, and (b) at least some of the one or more processors may be remote from other components of the display device. The one or more processors may be connected to each other or to other components in the light field camera either: (a) wirelessly, (b) by wired connection, or (c) by a combination of wired and wireless connections. For example, one or more electronic processors (e.g., 623, 625) may be housed in a computer 619, microprocessor or field programmable gate array.

In exemplary implementations, one or more computers are programmed to perform any and all algorithms described herein. For example, in some cases, programming for a computer is implemented as follows: (a) a machine-accessible medium has instructions encoded thereon that specify steps in an algorithm; and (b) the computer accesses the instructions encoded on the machine-accessible medium, in order to determine steps to execute in the algorithm. In exemplary implementations, the machine-accessible medium comprises a tangible non-transitory medium. For example, the machine-accessible medium may comprise (a) a memory unit or (b) an auxiliary memory storage device. For example, while a program is executing, a control unit in a computer may fetch the next coded instruction from memory.

Alternative Implementations:

This invention is not limited to the implementations described above. Here are some non-limiting examples of other ways in which this invention may be implemented.

In some cases, the front diffuser (e.g., 101, 601, 709) is replaced with another type of so-called "angle-averaging" layer. For example, in some cases, the front diffuser (e.g., 101, 601, 709) is replaced by a layer comprising holographic optical elements (HOEs) or by a layer comprising a microlens array.

In exemplary implementations, the light field display device (which creates the intermediate light field that is projected onto the diffuser) comprises two stacked LCDs.

However, in some cases, other types of light field display devices are used. For, example, in some cases: (a) the light field is created by a single LCD and a microlens array which are positioned behind the diffuser and which project a light field onto the diffuser; and (b) the algorithms performed by the processors (to compute the time-varying display that produces the light field) are modified. For example, in some cases where a single LCD and a microlens array are employed, Equation 7 is modified as follows:

$$\underset{\{l\}}{\text{minimize}} \quad \|i - Pl)\| \qquad (13)$$

$$\text{s.t.} \quad 0 \le l \le 1$$

where i is the target, high-resolution 2D image, l is the emitted light field, and P is the projection matrix. Equation 13 is easily solved by algorithms such as SART.

Figure 9:
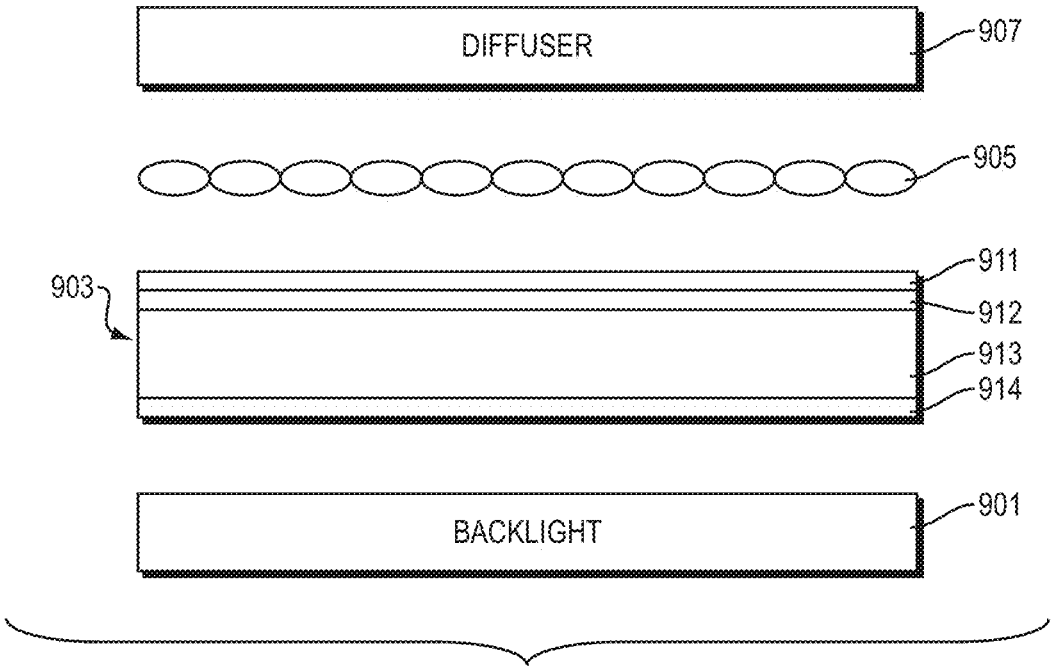
FIG. 9 shows a display device in which a single LCD and a microlens array create a light field that is projected on the rear of a diffuser.

FIG. 9 shows a display device in which a single LCD and a microlens array create a light field that is projected on the rear of a diffuser, in an illustrative implementation of this invention. In the example shown in FIG. 9, light travels from a backlight 901, then through the single LCD 903, then through a microlens array 905, then through a diffuser 907, and then to a human observer 909. The single LCD 903 comprises a polarizer layer 911, a color filter array 912, a liquid crystal layer 913, and another polarization layer 914. The color filter array 912 is optional.

A prototype implementation employs 120 Hz LCD panels. However, in other implementations, the refresh rate of the LCDs or other SLMs may vary. For example, in some cases, a refresh rate of 240 Hz is used, to produce better results for superresolution display. Or, for example, a refresh rate that is less than 240 Hz may be used.

In some implementations, the algorithms take into account, when calculating optimal display patterns: (a) panel-specific subpixel structures (e.g., in the LCDs or other SLMs); and (b) diffraction effects. Taking diffraction effects into account is particularly desirable as physical pixel sizes in the LCDs or other SLMs decrease.

In some implementations: (a) the algorithms are executed in real-time by FPGAs or other mobile processing units; (b) device electronics synchronize two LCDs at a high speed; and (c) the devise runs in unison with user input technologies for mobile devices, including capacitive multitouch sensing.

Definitions:

The terms "a" and "an", when modifying a noun, do not imply that only one of the noun exists.

An "automultiscopic" or "glasses-free 3D" display means a display, on or through a screen (or other layer), of a 3D image, which display, when viewed by a human not wearing glasses or other optical apparatus: (a) exhibits motion parallax and binocular parallax, and (b) includes multiple views, the view seen depending on the angle at which the image is viewed.

The term "camera" shall be construed broadly. Here are some non-limiting examples of a "camera": (a) an optical instrument that records images; (b) a digital camera; (c) a camera that uses photographic film or a photographic plate; (d) a light field camera; (e) a time-of-flight camera; (f) an imaging system, (g) a light sensor; (h) apparatus that includes a light sensor; or (i) apparatus for gathering data about light incident on the apparatus.

The term "comprise" (and grammatical variations thereof) shall be construed broadly, as if followed by "without limitation". If A comprises B, then A includes B and may include other things.

The term "computer" shall be construed broadly. For example, the term "computer" includes any computational device that performs logical and arithmetic operations. For example, a "computer" may comprise an electronic computational device. For example, a "computer" may: (a) a central processing unit, (b) an ALU (arithmetic/(logic unit), (c) a memory unit, and (d) a control unit that controls actions of other components of the computer so that encoded steps of a program are executed in a sequence. For example, the term "computer" may also include peripheral units, including an auxiliary memory storage device (e.g., a disk drive or flash memory). However, a human is not a "computer", as that term is used herein.

"Defined Term" means a term that is set forth in quotation marks in this Definitions section.

For an event to occur "during" a time period, it is not necessary that the event occur throughout the entire time period. For example, an event that occurs during only a portion of a given time period occurs "during" the given time period.

The term "e.g." means for example.

The fact that an "example" or multiple examples of something are given does not imply that they are the only instances of that thing. An example (or a group of examples) is merely a non-exhaustive and non-limiting illustration.

Unless the context clearly indicates otherwise: (1) the term "implementation" means an implementation of this invention; (2) the term "embodiment" means an embodiment of this invention; and (3) the phrase "in some cases" means in one or more implementations of this invention.

Unless the context clearly indicates otherwise: (1) a phrase that includes "a first" thing and "a second" thing does not imply an order of the two things (or that there are only two of the things); and (2) such a phrase is simply a way of identifying the two things, respectively, so that they each can be referred to later with specificity (e.g., by referring to "the first" thing and "the second" thing later). For example, unless the context clearly indicates otherwise, if an equation has a first term and a second term, then the equation may (or may not) have more than two terms, and the first term may occur before or after the second term in the equation. A phrase that includes a "third" thing, a "fourth" thing and so on shall be construed in like manner.

The term "for instance" means for example.

In the context of a display device (or components of the display device), "front" is optically closer to a human viewer, and "rear" is optically farther from the viewer, when the viewer is viewing a display produced by the device during normal operation of the device. The "front" and "rear" of a display device continue to be the front and rear, even when no viewer is present.

"Herein" means in this document, including text, specification, claims, abstract, and drawings.

The terms "horizontal" and "vertical" shall be construed broadly. For example, "horizontal" and "vertical" may refer to two arbitrarily chosen coordinate axes in a Euclidian two dimensional space, regardless of whether the "vertical" axis is aligned with the orientation of the local gravitational field. For example, a "vertical" axis may oriented along a local surface normal of a physical object, regardless of the orientation of the local gravitational field.

The term "include" (and grammatical variations thereof) shall be construed broadly, as if followed by "without limitation".

"Intensity" means any measure of or related to intensity, energy or power. For example, the "intensity" of light includes any of the following measures: irradiance, spectral irradiance, radiant energy, radiant flux, spectral power, radiant intensity, spectral intensity, radiance, spectral radiance, radiant exitance, radiant emittance, spectral radiant exitance, spectral radiant emittance, radiosity, radiant exposure or radiant energy density.

The term "light" means electromagnetic radiation of any frequency. For example, "light" includes, among other things, visible light and infrared light. Likewise, any term that directly or indirectly relates to light (e.g., "imaging") shall be construed broadly as applying to electromagnetic radiation of any frequency.

The term "light field projector" means a device that projects a set of light rays onto a set of pixels such that, for each respective pixel in the set of pixels: (i) a first subset of the set of light rays strikes the respective pixel at a first angle, and a second subset of the set of light rays strikes the respective pixel at a second angle, the first and second angles being different; (ii) the intensity of the lights rays in the first subset varies as a first function of time, and the intensity of the light rays in the second subset can varies as a second function of time, and (iii) the device controls the intensity of the first subset of rays independently of the intensity of the second subset of rays. In the preceding sentence, angles are defined relative to a direction that is perpendicular to a reference plane.

The term "matrix" includes a matrix that has two or more rows, two or more columns, and at least one non-zero entry. The term "matrix" also includes a vector that has at least one non-zero entry and either (a) one row and two or more columns, or (b) one column and two or more rows. However, as used herein, (i) a scalar is not a "matrix", and (ii) a rectangular array of entries, all of which are zero (i.e., a so-called null matrix), is not a "matrix".

To "multiply" includes to multiply by an inverse. Thus, to "multiply" includes to divide.

The term "or" is inclusive, not exclusive. For example A or B is true if A is true, or B is true, or both A or B are true. Also, for example, a calculation of A or B means a calculation of A, or a calculation of B, or a calculation of A and B.

A parenthesis is simply to make text easier to read, by indicating a grouping of words. A parenthesis does not mean that the parenthetical material is optional or can be ignored.

To compute a term that "satisfies" an equation: (a) does not require that calculations involve terms, variables or operations that are in the equation itself, as long as the term itself (subject to error, as described in part (b) of this sentence) is computed; and (b) includes computing a solution that differs from a correct solution by an error amount, which error amount arises from one or more of (i) rounding, (ii) imprecision in a computation or representation of a floating point number by a computer, (iii) computational imprecision arising from using too few terms (e.g., a finite number of terms in a series) or using too few iterations or (iv) other computational imprecision, including error due to modeling a continuous signal by a discrete signal or due to using an insufficiently small step size in calculations, and (iii) signal noise or other physical limitations of sensors or other physical equipment.

As used herein, the term "set" does not include a so-called empty set (i.e., a set with no elements). Mentioning a first set and a second set does not, in and of itself, create any implication regarding whether or not the first and second sets overlap (that is, intersect).

A "spatial light modulator", also called an "SLM", is a device that (i) either transmits light through the device or reflects light from the device, and (ii) either (a) attenuates the light, such that the amount of attenuation of a light ray incident at a point on a surface of the device depends on at least the 2D spatial position of the point on the surface; or (b) changes the phase of the light, such that the phase shift of a light ray incident at a point on a surface of the device depends on at least the 2D spatial position of the point on the surface. A modulation pattern displayed by an SLM may be either time-invariant or time-varying.

As used herein, a "subset" of a set consists of less than all of the elements of the set.

The term "such as" means for example.

Spatially relative terms such as "under", "below", "above", "over", "upper", "lower", and the like, are used for ease of description to explain the positioning of one element relative to another. The terms are intended to encompass different orientations of an object in addition to different orientations than those depicted in the figures.

A matrix may be indicated by a bold capital letter (e.g., D). A vector may be indicated by a bold lower case letter (e.g., a ). However, the absence of these indicators does not indicate that something is not a matrix or not a vector.

Except to the extent that the context clearly requires otherwise, if steps in a method are described herein, then: (1) steps in the method may occur in any order or sequence, even if the order or sequence is different than that described; (2) any step or steps in the method may occur more than once; (3) different steps, out of the steps in the method, may occur a different number of times during the method, (4) any step or steps in the method may be done in parallel or serially; (5) any step or steps in the method may be performed iteratively; (6) a given step in the method may be applied to the same thing each time that the particular step occurs or may be applied to different things each time that the given step occurs; and (7) the steps described are not an exhaustive listing of all of the steps in the method, and the method may include other steps.

This Definitions section shall, in all cases, control over and override any other definition of the Defined Terms. For example, the definitions of Defined Terms set forth in this Definitions section override common usage or any external dictionary. If a given term is explicitly or implicitly defined in this document, then that definition shall be controlling, and shall override any definition of the given term arising from any source (e.g., a dictionary or common usage) that is external to this document. If this document provides clarification regarding the meaning of a particular term, then that clarification shall, to the extent applicable, override any definition of the given term arising from any source (e.g., a dictionary or common usage) that is external to this document. To the extent that any term or phrase is defined or clarified herein, such definition or clarification applies to any grammatical variation of such term or phrase, taking into account the difference in grammatical form. For example, the grammatical variations include noun, verb, participle, adjective, or possessive forms, or different declensions, or different tenses. In each case described in this paragraph, Applicant is acting as Applicant's own lexicographer.

Variations:

In one aspect, this invention is a method comprising, in combination: (a) transmitting light through a first spatial light modulator, then through a second spatial light modulator, and then through a diffuser layer, such that a front side of the diffuser layer displays a set of one or more displayed images; (b) using one or more processors (i) to execute an optimization algorithm to compute optimal pixel states of pixels in the first and second spatial light modulators, respectively, such that for each respective displayed image in the set of displayed images, the optimal pixel states minimize, subject to one or more constraints, a difference between a target image and the respective displayed image, and (ii) to output signals, which signals encode instructions to control actual pixel states of the pixels, based on the optimal pixel states computed in step (b)(i); and (c) in accordance with the instructions, varying the actual pixel states of the pixels; wherein (A) the first spatial light modulator has a first spatial resolution, the second spatial light modulator has a second spatial resolution, and the set of displayed images has a third spatial resolution, and (B) the third spatial resolution is greater than the first spatial resolution and is greater than the second spatial resolution. In some cases, the spatial light modulators are liquid crystal displays. In some cases, (a) the set of displayed images comprises a time-varying sequence of displayed images; (b) the sequence of displayed images is displayed under conditions, including lighting conditions, that have a flicker fusion rate for a human being; and (c) the sequence of displayed images is displayed at a frame rate that equals or exceeds four times the flicker fusion rate. In some cases, the frame rate is greater than or equal to 200 Hz and less than or equal to 280 Hz. In some cases, the optimization algorithm includes calculations involving a splitting variable, which splitting variable is a matrix that encodes an intermediate light field produced by the first and second spatial light modulators. In some cases, the optimization algorithm is split by a splitting variable into subproblems, which splitting variable is a matrix that encodes an intermediate light field produced by the first and second spatial light modulators. In some cases, the optimization algorithm includes an alternating direction method of multipliers (ADMM) algorithm. In some cases, the optimization algorithm includes a Simultaneous Algebraic Reconstruction Technique (SART) algorithm. In some cases, the optimization algorithm includes steps for non-negative matrix factorization in accordance with multiplicative update rules. Each of the cases described above in this paragraph is an example of the method described in the first sentence of this paragraph, and is also an example of an embodiment of this invention that may be combined with other embodiments of this invention.

In another aspect, this invention is an apparatus comprising, in combination: (a) a diffuser layer; (b) a rear spatial light modulator (SLM); (c) a front SLM positioned between the rear SLM and the diffuser layer; and (d) one or more computers programmed to perform computations and output signals to control the front and rear SLMs such that a front side of the diffuser layer displays a set of one or more displayed images, wherein (i) the computations include executing an optimization algorithm to compute optimal pixel states of pixels in the front and rear SLMs, respectively, such that for each respective displayed image in the set of displayed images, the optimal pixel states minimize, subject to one or more constraints, a difference between a target image and the respective displayed image, and (ii) the spatial resolution of the set of displayed images is greater than the spatial resolution of the first SLM and is greater than the spatial resolution of the second SLM. In some cases, the SLMs are liquid crystal displays. In some cases, (a) the set of displayed images comprises a temporal sequence of images; (b) the one or more computers are programmed to cause the sequence of images to be displayed at a frame rate that exceeds 100 Hz. Each of the cases described above in this paragraph is an example of the apparatus described in the first sentence of this paragraph, and is also an example of an embodiment of this invention that may be combined with other embodiments of this invention.

In another aspect, this invention is an apparatus comprising, in combination: (a) a diffuser layer; (b) a switch for activating or deactivating the diffuser layer, such that the diffuser layer is transparent when deactivated; (c) a light field projector for projecting a light field onto a rear side of the diffuser layer, such that light exiting the front side of the diffuser layer displays a temporal sequence of displayed images, which light field projector includes one or more spatial light modulators; and (d) one or more computers programmed (i) to execute an optimization algorithm to compute optimal pixel states of pixels in the one or more spatial light modulators, respectively, such that for each respective displayed image in a temporal sequence of displayed images, the optimal pixel states minimize, subject to one or more constraints, a difference between a target image and the respective displayed image, and (ii) to output signals to control the one or more spatial light modulators. In some cases, the one or more spatial light modulators comprise liquid crystal displays. In some cases, the light field projector includes two spatial light modulators. In some cases, the light field projector includes a spatial light modulator and a microlens array. In some cases, when the diffuser layer is not transparent: (a) the one or more spatial light modulators have one or more spatial resolutions, including a maximum SLM spatial resolution, which maximum SLM spatial resolution is the highest of these one or more spatial resolutions; (b) the displayed images have a spatial resolution; and (c) the spatial resolution of the displayed images is higher than the maximum SLM spatial resolution. In some cases, when the diffuser layer is transparent: (a) the one or more spatial light modulators have one or more dynamic ranges, including a maximum SLM dynamic range, which maximum SLM dynamic range is the highest of these one or more dynamic ranges; (b) the displayed images have a dynamic range; and (c) the dynamic range of the displayed images is higher than the maximum SLM dynamic range. In some cases, when the diffuser layer is transparent, each of the displayed images comprises an automultiscopic display. In some cases, the switch is electronic. Each of the cases described above in this paragraph is an example of the apparatus described in the first sentence of this paragraph, and is also an example of an embodiment of this invention that may be combined with other embodiments of this invention.

While exemplary implementations are disclosed, many other implementations will occur to one of ordinary skill in the art and are all within the scope of the invention. Each of the various embodiments described above may be combined with other described embodiments in order to provide multiple features. Furthermore, while the foregoing describes a number of separate embodiments of the apparatus and method of the present invention, what has been described herein is merely illustrative of the application of the principles of the present invention. Other arrangements, methods, modifications, and substitutions by one of ordinary skill in the art are therefore also within the scope of the present invention. Numerous modifications may be made by one of ordinary skill in the art without departing from the scope of the invention.

What is claimed is:

1. A method comprising, in combination:

(a) transmitting light through a first spatial light modulator, then through a second spatial light modulator, and then through a diffuser layer, such that a front side of the diffuser layer displays a time-varying sequence of images that is observable, by temporal integration, as an observable image;

(b) using one or more processors (i) to execute an optimization algorithm to compute optimal pixel states of pixels in the first and second spatial light modulators, respectively, such that the optimal pixel states minimize, subject to one or more constraints, a difference between a target image and the observable image, and (ii) to output signals, which signals encode instructions to control actual pixel states of the pixels, based on the optimal pixel states computed in step (b)(i); and (c) in accordance with the instructions, varying the actual pixel states of the pixels;

wherein (A) the first spatial light modulator has a first spatial resolution, the second spatial light modulator has a second spatial resolution, and the observable image has a third spatial resolution, (B) the third spatial resolution is greater than the first spatial resolution and is greater than the second spatial resolution, (C) the observable image is displayed on the diffuser layer and comprises a projection, over an angular domain, of a light field incident on the diffuser layer, and (D) the optimization algorithm includes calculations involving a splitting variable, which splitting variable is a matrix that encodes an intermediate light field produced by the first and second spatial light modulators.

2. The method of claim 1, wherein the spatial light modulators are liquid crystal displays.

3. The method of claim 1, wherein:

(a) the sequence of images is displayed under conditions, including lighting conditions, that have a flicker fusion rate for a human being; and (b) the sequence of images is displayed at a frame rate that equals or exceeds four times the flicker fusion rate.

4. The method of claim 3, wherein the frame rate is greater than or equal to 200 Hz and less than or equal to 280 Hz.

5. The method of claim 1, wherein the optimization algorithm is split by the splitting variable into subproblems, which splitting variable is a matrix that encodes an intermediate light field produced by the first and second spatial light modulators.

6. The method of claim 1, wherein the optimization algorithm includes an alternating direction method of multipliers (ADMM) algorithm.

7. The method of claim 1, wherein the optimization algorithm includes a Simultaneous Algebraic Reconstruction Technique (SART) algorithm.

8. The method of claim 1, wherein the optimization algorithm includes steps for non-negative matrix factorization in accordance with multiplicative update rules.

9. Apparatus comprising, in combination:

(a) a diffuser layer;

(b) a rear spatial light modulator (SLM);

(c) a front SLM positioned between the rear SLM and the diffuser layer; and (d) one or more computers programmed to perform computations and output signals to control the front and rear SLMs such that:

(i) a front side of the diffuser layer displays a time-varying sequence of images that is observable, by temporal integration, as an observable image, (ii) the computations include executing an optimization algorithm to compute optimal pixel states of pixels in the front and rear SLMs, respectively, such that the optimal pixel states minimize, subject to one or more constraints, a difference between a target image and the observable image, (iii) the spatial resolution of the observable image is greater than the spatial resolution of the front SLM and is greater than the spatial resolution of the rear SLM, (iv) the observable image is displayed on the diffuser layer and comprises a projection, over an angular domain, of a light field incident on the diffuser layer, and (v) the optimization algorithm includes calculations involving a splitting variable, which splitting variable is a matrix that encodes an intermediate light field produced by the rear and front spatial light modulators.

10. The apparatus of claim 9, wherein the SLMs are liquid crystal displays.

11. The apparatus of claim 9, wherein the one or more computers are programmed to cause the sequence of images to be displayed at a frame rate that exceeds 100 Hz.

12. Apparatus comprising, in combination:

(a) a diffuser layer;

(b) a switch for activating or deactivating the diffuser layer, such that the diffuser layer is transparent when deactivated;

(c) a light field projector for projecting a light field onto a rear side of the diffuser layer, such that light exiting the front side of the diffuser layer displays a time-varying sequence of images that is observable, by temporal integration, as an observable image, which light field projector includes a first SLM and a second SLM; and (d) one or more computers programmed (i) to execute an optimization algorithm to compute optimal pixel states of pixels in the first SLM and second SLM, respectively, such that the optimal pixel states minimize, subject to one or more constraints, a difference between a target image and the observable image, and (ii) to output signals to control the first and second SLMs wherein (A) the observable image is a projection, over an angular domain, of a light field incident on the diffuser layer, (B) the optimization algorithm includes calculations involving a splitting variable, which splitting variable is a matrix that encodes an intermediate light field produced by the first and second SLMs, and (C) when the diffuser layer is not transparent, the spatial resolution of the observable image is greater than the spatial resolution of the first SLM and is greater than the spatial resolution of the second SLM.

13. The apparatus of claim 12, wherein the one or more spatial light modulators comprise liquid crystal displays.

14. The apparatus of claim 12, wherein the light field projector includes a spatial light modulator and a microlens array.

15. The apparatus of claim 12, wherein, when the diffuser layer is transparent:

(a) the spatial light modulators have one or more dynamic ranges, including a maximum SLM dynamic range, which maximum SLM dynamic range is the highest of these one or more dynamic ranges;

(b) the observable image has a dynamic range; and (c) the dynamic range of the observable image is higher than the maximum SLM dynamic range.

16. The apparatus of claim 12, wherein, when the diffuser layer is transparent, the observable image comprises an auto-multiscopic display.

17. The apparatus of claim 12, wherein the switch is electronic.

* * * * *